US005332034A

United States Patent [19]

Chiang et al.

[11] Patent Number: 5,332,034

[45] Date of Patent: Jul. 26, 1994

[54] HEAT EXCHANGER TUBE

[75] Inventors: Robert H. L. Chiang, Liverpool; Jack L. Esformes, N. Syracuse, both of N.Y.

[73] Assignee: Carrier Corporation, Syracuse, N.Y.

[21] Appl. No.: 991,777

[22] Filed: Dec. 16, 1992

[51] Int. Cl.[5] ..... F28F 1/40

[52] U.S. Cl. ..... 165/184; 165/133

[58] Field of Search ..... 165/133, 184; 138/38

[56] References Cited

U.S. PATENT DOCUMENTS

| | | | |
|---|---|---|---|
| 3,273,599 | 8/1966 | Heeren | 138/38 |
| 3,326,283 | 6/1967 | Ware | 165/181 |
| 3,861,462 | 1/1975 | McLain | 165/179 |
| 3,885,622 | 5/1975 | McLain | 165/179 |
| 4,245,695 | 1/1981 | Fujikake | 165/133 |
| 4,715,436 | 12/1987 | Takahashi et al. | 165/133 |
| 4,733,698 | 3/1988 | Sato | 138/38 |
| 5,052,476 | 10/1991 | Sukumoda et al. | 165/133 |
| 5,070,937 | 12/1991 | Mongin et al. | 165/133 |

FOREIGN PATENT DOCUMENTS

| | | | |
|---|---|---|---|
| 54-157369 | 12/1979 | Japan | 165/184 |
| 3-207995 | 9/1991 | Japan | 165/184 |
| 4-03892 | 1/1992 | Japan | 165/184 |

*Primary Examiner*—Allen J. Flanigan

[57] ABSTRACT

A heat exchanger tube having an internal surface that enhances the heat transfer performance of the tube. The internal surface has ribs that run substantially parallel to the longitudinal axis of the tube. The ribs have a pattern of parallel notches intersecting and impressed into them at an angle oblique to the longitudinal axis. The pattern of ribs and notches increase the total internal surface area of the tube and also promote conditions for the flow of refrigerant within the tube that increase heat transfer performance.

6 Claims, 5 Drawing Sheets

HEAT EXCHANGER TUBE

BACKGROUND OF THE INVENTION

This invention relates generally to tubes used in heat exchangers for transferring heat between a fluid inside the tube and a fluid outside the tube. More particularly, the invention relates to a heat exchanger tube having an internal surface that is capable of enhancing the heat transfer performance of the tube. Such a tube is adapted to use in the heat exchangers of air conditioning, refrigeration (AC&R) or similar systems.

Designers of heat transfer tubes have long recognized that the heat transfer performance of a tube having surface enhancements is superior to a smooth walled tube. A wide variety of surface enhancements have been applied to both internal and external tube surfaces including ribs, fins, coatings and inserts, to name just a few. Common to nearly all enhancement designs is an attempt to increase the heat transfer surface area of the tube. Most designs also attempt to encourage turbulence in the fluid flowing through or over the tube in order to promote fluid mixing and break up the boundary layer at the surface of the tube.

A large percentage of AC&R, as well as engine cooling, heat exchangers are of the plate fin and tube type. In such heat exchangers, the tubes are externally enhanced by use of plate fins affixed to the exterior of the tubes. The heat exchanger tubes also frequently have internal heat transfer enhancements in the form of modifications to the interior surface of the tube.

As is implicit in their names, the fluid flowing through a condenser undergoes a phase change from gas to liquid and the fluid flowing through an evaporator changes phase from a liquid to a gas. Heat exchangers of both types are needed in vapor compression AC&R systems. In order to simplify acquisition and stocking as well as to reduce costs of manufacturing, it is desirable that the same type of tubing be used in all the heat exchangers of a system. But heat transfer tubing that is optimized for use in one application frequently does not perform as well when used in the other application. To obtain maximum performance in a given system under these circumstances, it would be necessary to use two types of tubing, one for each functional application. But there is at least one type of AC&R system where a given heat exchanger must perform both functions, i.e. a reversible vapor compression or heat pump type air conditioning system. It is not possible to optimize a given heat exchanger for a single function in such a system and the heat exchangers must be able to perform both functions well.

To simplify manufacturing and reduce costs as well as to obtain improved heat transfer performance, what is needed is an heat transfer tube that has a heat transfer enhancing interior surface that is able to perform well in both condensing and evaporating applications. The interior heat transfer surface must be readily adaptable to being easily and inexpensively manufactured.

In a significant proportion of the total length of the tubing in a typical plate fin and tube AC&R heat exchanger, the flow of refrigerant flow is mixed, i.e. the refrigerant exists in both liquid and vapor states. Because of the variation in density, the liquid refrigerant flows along the bottom of the tube and the vaporous refrigerant flows along the top. Heat transfer performance of the tube is improved if there is improved intermixing between the fluids in the two states, e.g. by promoting drainage of liquid from the upper region of the tube in a condensing application or encouraging liquid to flow up the tube inner wall by capillary action in an evaporating application.

SUMMARY OF THE INVENTION

The heat exchanger tube of the present invention has an internal surface that is configured to enhance the heat transfer performance of the tube. The internal enhancement is a ribbed internal surface with the ribs being substantially parallel to the longitudinal axis of the tube. The ribs have a pattern of parallel notches impressed into them at an angle oblique to the longitudinal axis of the tube. The surface increases the internal surface area of the tube and thus increases the heat transfer performance of the tube. In addition, the notched ribs promote flow conditions within the tube that also promote heat transfer. The configuration of the enhancement gives improved heat transfer performance both in a condensing and a evaporating application. In the region of a plate fin and tube heat exchanger constructed of tubing embodying the present invention where the flow of fluid is of mixed states and has a high vapor content, the configuration promotes turbulent flow at the internal surface of tube and thus serves to improve heat transfer performance. In the regions of the heat exchanger where there is a low vapor content, the configuration promotes both condensate drainage in a condensing environment and capillary movement of liquid up the tube walls in a evaporating environment.

The tube of the present invention is adaptable to manufacturing from a copper or copper alloy strip by roll embossing the enhancement pattern on one surface on the strip before roll forming and seam welding the strip into tubing. Such a manufacturing process is capable of rapidly and economically producing internally enhanced heat transfer tubing.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
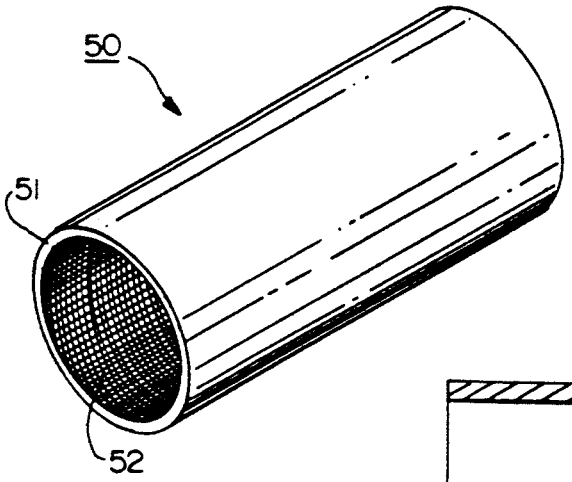
FIG. 1 is a pictorial view of the heat exchanger tube of the present invention.

FIG. 1 shows, in an overall isometric view, the heat exchanger tube of the present invention. Tube 50 has tube wall 51 upon which is formed internal surface enhancement 52.

Figure 2:
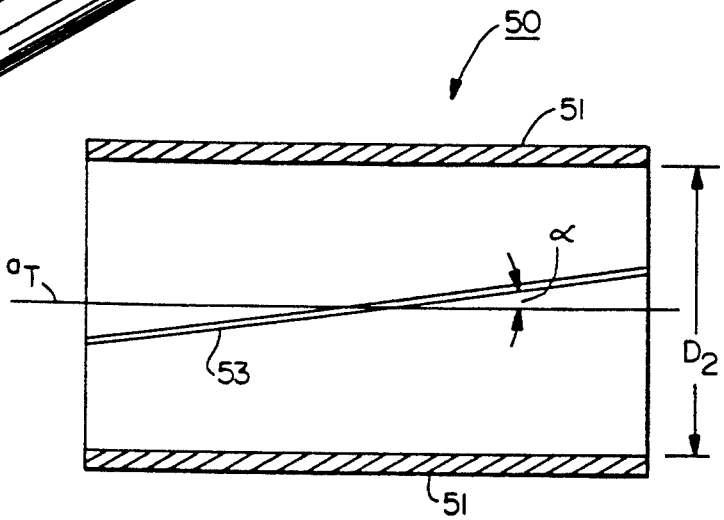
FIG. 2 is a sectioned elevation view of the heat exchanger tube of the present invention.

FIG. 2 depicts heat exchanger tube 50 in a cross sectioned elevation view. Only a single rib 53 of surface enhancement 52 (FIG. 1) is shown in FIG. 2 for clarity, but in the tube of the present invention, a plurality of ribs 14, all parallel to each other, extend out from wall 51 of tube 50. Rib 53 is inclined at angle $\alpha$ from tube longitudinal axis $a_r$. Tube 10 has internal diameter, as measured from the internal surface of the tube between ribs, $D_i$.

Figure 3:
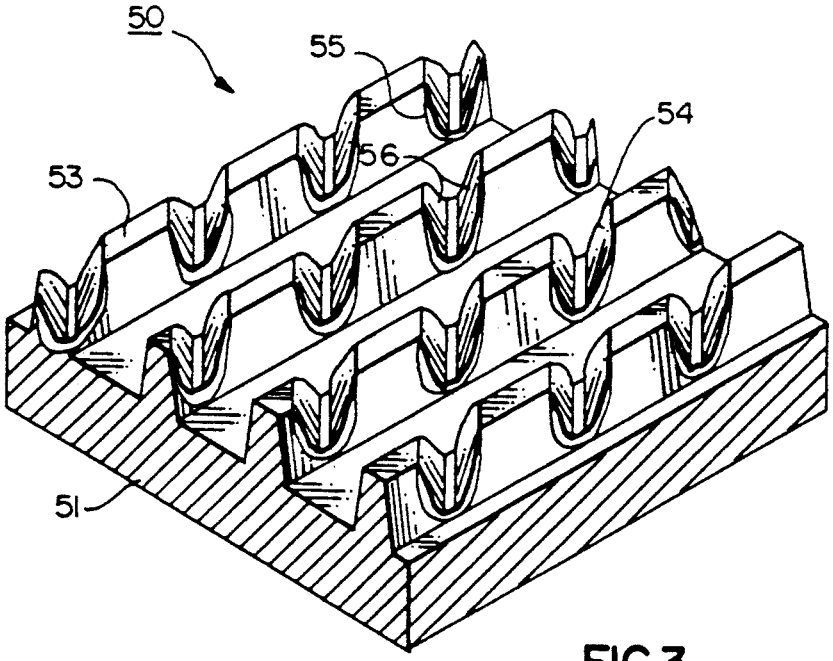
FIG. 3 is a pictorial view of a section of the wall of the heat exchanger tube of the present invention.

FIG. 3 is an isometric view of a portion of wall 51 of heat exchanger tube 50 depicting details of surface enhancement 52. Extending outward from wall 51 are a plurality of ribs 53. At intervals along the ribs are a series of notches 54. As will be described below, notches 54 are formed in ribs 53 by a rolling process. The material displaced as the notches are formed is left as a projection 55 that projects outward from each side of a given rib 53 around each notch 54 in that rib. The projections have a salutary effect on the heat transfer performance of the tube, as they both increase the surface area of the tube exposed to the fluid flowing through the tube and also promote turbulence in the fluid flow near the tube inner surface.

Figure 4:
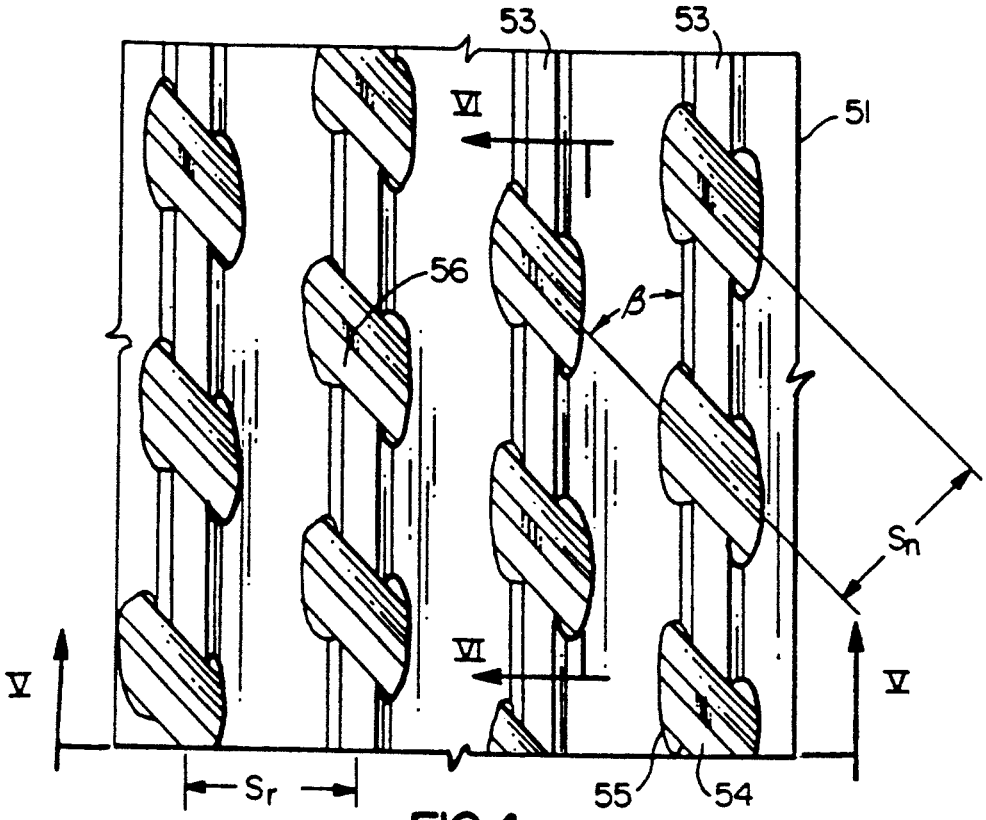
FIG. 4 is a plan view of a section of the wall of the heat exchanger tube of the present invention.

FIG. 4 is a plan view of a portion of wall 51 of tube 50. The figure shows ribs 53 disposed on the wall at rib spacing $S_r$. Notches 54 are impressed into the ribs at notch interval $S_n$. The angle of incidence between the notches and the ribs is angle $\beta$.

Figure 5:
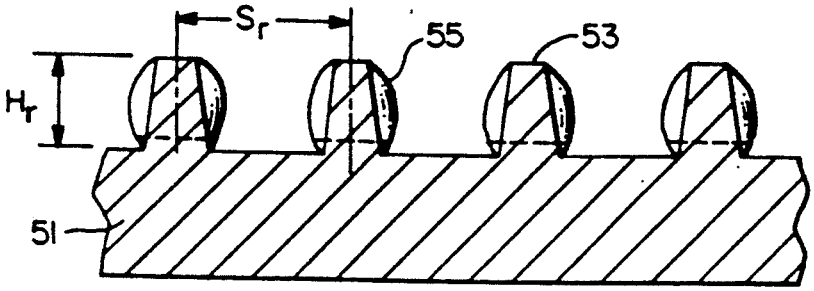
FIG. 5 is a section view of the wall of the heat exchanger tube of the present invention taken through line V—V in FIG. 4.

FIG. 5 is a section view of wall 51 taken through line V—V in FIG. 4. The figure shows that ribs 53 have height $H_r$ and have rib spacing $S_r$.

Figure 6:
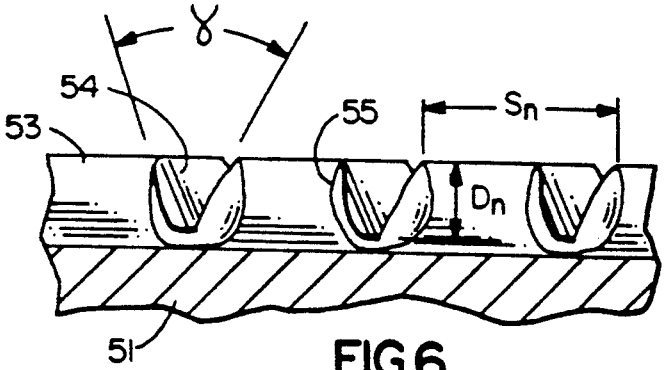
FIG. 6 is a section view of the wall of the heat exchanger tube of the present invention taken through line VI—VI in FIG. 4.

FIG. 6 is a section view of wall 51 taken through line VI—VI in FIG. 4. The figure shows that notches 54 have an angle between opposite notch faces 56 of $\gamma$ and are impressed into ribs 54 to a depth of $D_n$. The interval between adjacent notches is $S_n$.

For optimum heat transfer consistent with minimum fluid flow resistance, a tube embodying the present invention and having a nominal outside diameter of 20 mm ($\frac{3}{4}$ inch) or less should have an internal enhancement with features as described above and having the following parameters:

a. the axis of the ribs should be substantially parallel to the longitudinal axis of the tube, or $$\alpha \approx 0°;$$

b. the ratio of the rib height to the inner diameter of the tube should be between 0.02 and 0.04, or $$0.02 \leqq H_r/D_i \leqq 0.04;$$

c. the angle of incidence between the rib axis and the notch axis should be between 20 and 90 degrees, or $$20° \leqq \beta \leqq 90°;$$

d. the ratio between the interval between notches in a rib and the tube inner diameter should be between 0.025 and 0.07, or $$0.025 \leqq S_n/D_i \leqq 0.07;$$

e. the notch depth should be between 40 and 100 percent of the rib height, or $$0.4 \leqq D_n/H_r \leqq 1.0; \text{ and}$$

f. the angle between the opposite faces of a notch should be less than 90 degrees, or $$\gamma \leqq 90°.$$

Figure 7:
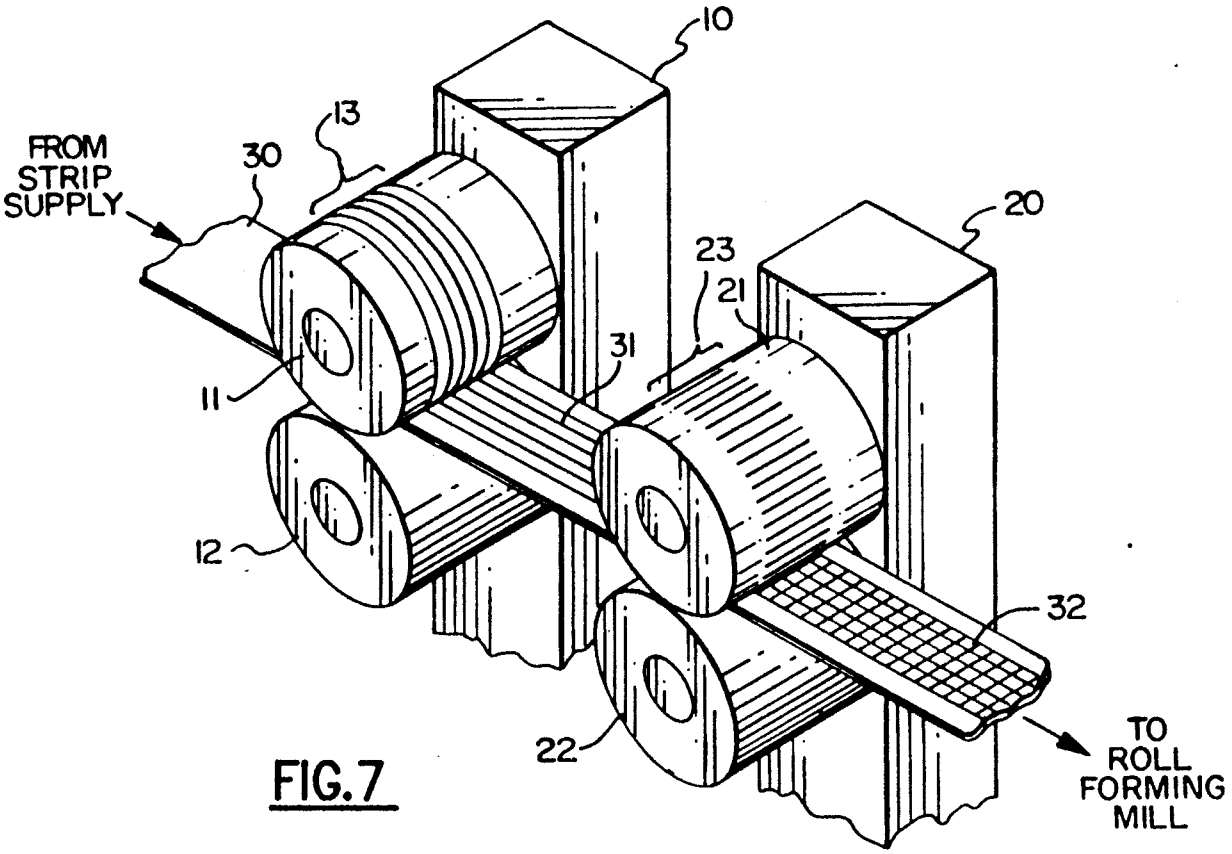
FIG. 7 is a schematic view of one method of manufacturing the heat exchanger tube of the present invention.

Enhancement 52 may be formed on the interior of tube wall by any suitable process. In the manufacture of seam welded metal tubing using modern automated high speed processes, an effective method is to apply the enhancement pattern by roll embossing on one surface of a metal strip before the strip is roll formed into a circular cross section and seam welded into a tube. FIG. 7 illustrates how this may be done. Two roll embossing stations, respectively 10 and 20, are positioned in the production line for roll forming and seam welding metal strip 30 into tubing between the source of supply of unworked metal strip and the portion of the production line where the strip is roll formed into a tubular shape. Each embossing station has a patterned enhancement roller, respectively 11 and 21, and a backing roller, respectively 12 and 22. The backing and patterned rollers in each station are pressed together with sufficient force, by suitable means (not shown), to cause, for example, patterned surface 13 on roller 11 to be impressed into the surface of one side of strip 30, thus forming enhancement pattern 31 on the strip. Patterned surface 13 is the mirror image of the axially ribbed portion of the surface enhancement in the finished tube. Patterned surface 23 on roller 21 has a series of raised projections that press into the ribs formed by patterned surface 13 and form the notches in the ribs in the finished tube.

If the tube is manufactured by roll embossing, roll forming and seam welding, it is likely that there will be a region along the line of the weld in the finished tube that either lacks the enhancement configuration that is present around the remainder of the tube inner circumference, due to the nature of the manufacturing process, or has a different enhancement configuration. This region of different configuration will not adversely affect the thermal or fluid flow performance of the tube in any significant way.

Figure 8:
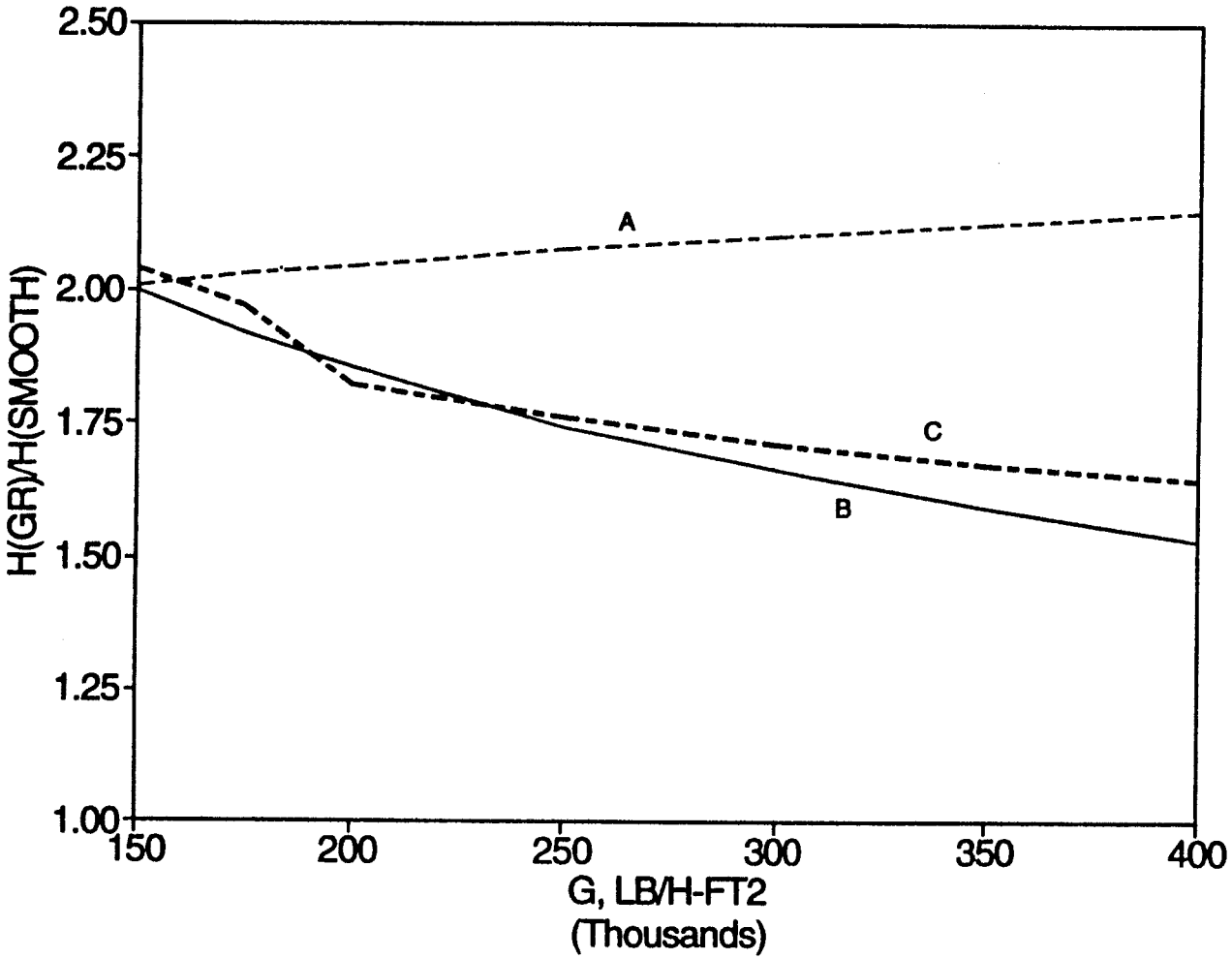
FIG. 8 is a graph showing the relative performance of the tube of the present invention compared to two prior art tubes when the tubes are used in an evaporating application.

The present tube offers performance advantages over prior art heat transfer tubes in both evaporating and condensing heat exchangers. Curve A in FIG. 8 shows the relative evaporating performance (H(GR)/H(SMOOTH)) of the present tube compared to a tube having a smooth inner surface over a range of mass flow velocities (G,LB/H-FT2) of refrigerant through the tube. By comparison, curve B shows the same relative performance information for a tube having longitudinal ribs but no notches and curve C shows the same information for a typical prior art tube having helical internal ribs. The graph of FIG. 8 shows that the evaporating performance of the present tube is superior to both prior art tubes over a wide range of flow rates.

Figure 9:
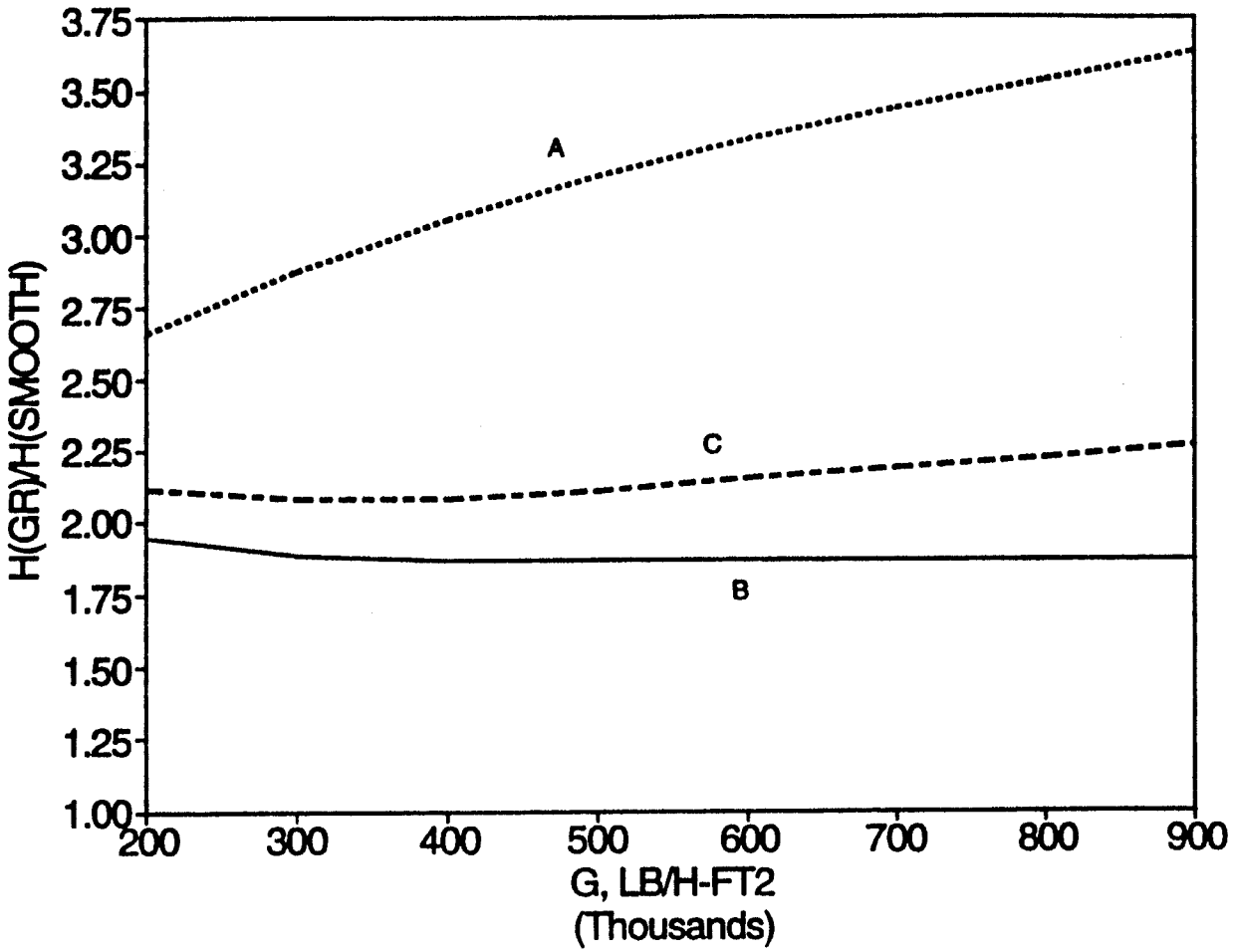
FIG. 9 is a graph showing the relative performance of the tube of the present invention compared to two prior art tubes when the tubes are used in a condensing application.

In the same manner as in FIG. 8, curve A in FIG. 9 shows the relative condensing performance of the present tube compared to a tube having a smooth inner surface over a range of mass flow velocities of refrigerant through the tube. Curve B shows the same relative performance information for a longitudinally ribbed tube having no notches and curve C shows the same information for a typical helically ribbed tube. The graph of FIG. 9 shows that the condensing performance of the present tube is superior to both prior art tubes over a wide range of flow rates.

We claim:

1. An improved heat exchanger tube (50) having
a wall (51) having an inner surface,
an inner diameter ($D_i$),
a longitudinal axis $a_r$) and
a plurality of ribs (53) formed on said inner surface,
each of said ribs having
two opposite sides and
a height ($H_r$) and
extending substantially parallel to said longitudinal axes, in which the improvement comprises:

a pattern of parallel notches (54), each notch having opposite first and second faces (56) opposite and inclined to each other and that portion of said notch where said first face is closest to said second face being proximal to said inner surface, impressed into said ribs to a depth ($H_n$) of at least 40 percent of said rib height and at an angle ($\beta$) oblique to said longitudinal axis;

the ratio of said rib height to said tube inner diameter being between 0.02 and 0.04; and the ratio between the interval ($S_n$) between notches in a rib and said tube inner diameter being between 0.025 and 0.07.

2. The heat exchanger tube of claim 1 in which the angle ($\gamma$) between opposite faces (56) of said notch is less than 90 degrees.

3. The heat exchanger tube of claim 1 in which the angle ($\beta$) at which said notch pattern intersects said ribs is between 20 and 90 degrees.

4. The heat exchanger tube of claim 3 in which said angle ($\beta$) of intersection is 45 degrees.

5. The heat exchanger tube of claim 1 in which a projection (55), comprised of material displaced from a rib as a notch is formed in said rib, extends outward from said opposite sides of said rib in the vicinity of each notch in said rib.

6. The heat exchanger tube of claim 1 in which said ribs are disposed at substantially equal intervals around said heat transfer tube internal surface.

* * * * *